US006732948B1

(12) United States Patent
Buckley

(10) Patent No.: US 6,732,948 B1
(45) Date of Patent: May 11, 2004

(54) FUEL INJECTOR

(75) Inventor: Paul Buckley, Kent (GB)

(73) Assignee: Delphi Technolgies, Inc., Troy, MI (US)

( * ) Notice: Subject to any disclaimer, the term of this patent is extended or adjusted under 35 U.S.C. 154(b) by 194 days.

(21) Appl. No.: 09/831,072

(22) PCT Filed: Oct. 9, 2000

(86) PCT No.: PCT/GB00/03877

§ 371 (c)(1),
(2), (4) Date: Aug. 13, 2001

(30) Foreign Application Priority Data

Oct. 9, 1999 (GB) ..... 9923823

(51) Int. Cl.[7] ..... B05B 1/08

(52) U.S. Cl. ..... 239/102.2; 239/102.1; 239/87; 239/92; 123/506; 251/129.06

(58) Field of Search ..... 239/102.2, 102.1, 239/88–96, 124, 533.2–533.12; 123/506, 498; 251/129.06; 310/311, 326, 327

(56) References Cited

U.S. PATENT DOCUMENTS 4,909,440 A * 3/1990 Mitsuyasu et al. ..... 239/96
4,917,068 A * 4/1990 Takahashi et al. ..... 123/506
5,036,821 A * 8/1991 Horiuchi et al. ..... 123/506
5,551,398 A 9/1996 Gibson et al.
5,875,764 A 3/1999 Kappel et al.
6,012,430 A * 1/2000 Cooke ..... 123/506
6,105,884 A 8/2000 Molnar et al.
6,123,275 A 9/2000 Geiger et al.
6,186,421 B1 2/2001 Wahba et al.
6,189,817 B1 2/2001 Lambert
6,260,537 B1 7/2001 Lamb et al.
6,264,112 B1 7/2001 Landschoot et al.
6,276,339 B1 8/2001 Shebert, Jr. et al.
6,279,840 B1 8/2001 Buckley
6,318,641 B1 11/2001 Knebel et al.
6,328,232 B1 12/2001 Haltiner, Jr. et al.
6,336,595 B1 1/2002 Barbier
6,338,445 B1 1/2002 Lambert et al.
6,340,017 B1 1/2002 Dick
6,340,121 B1 1/2002 Lambert
6,345,606 B1 2/2002 Ricci-Ottati et al.
6,363,917 B1 4/2002 Hopley
6,364,222 B1 4/2002 Haltiner, Jr. et al.
6,373,363 B1 4/2002 Spakowski et al.
6,378,503 B1 4/2002 Lambert
6,390,067 B1 5/2002 Haltiner, Jr. et al.
6,390,069 B1 * 5/2002 Jiang et al. ..... 123/506
6,390,385 B1 5/2002 Hardy et al.

(List continued on next page.)

FOREIGN PATENT DOCUMENTS

EP 0 371 469 6/1990
EP 0 905 719 3/1999
EP 0 937 891 8/1999

*Primary Examiner*—Dinh Q. Nguyen
(74) *Attorney, Agent, or Firm*—Cantor Colburn LLP

(57) ABSTRACT

A fuel injector for use in an injector arrangement including a pumping plunger, a pump chamber and a spill valve arrangement controlling communication between the pump chamber and a low pressure fuel reservoir. The fuel injector comprises a valve needle which is engageable with a seating to control fuel delivery through a fuel injector outlet opening, a first control chamber being arranged such that the fuel pressure therein acts on a surface associated with the valve needle and a second control chamber being arranged such that fuel pressure therein acts on a surface associated with the spill valve arrangement. The injector further comprises a piezoelectric actuator arrangement including a piezoelectric element having first and second ends, the first end being associated with the spill valve arrangement and the second end being associated with the valve needle such that, in use, operation of the spill valve arrangement and movement of the valve needle is controlled by controlling the energisation level of the piezoelectric element.

12 Claims, 4 Drawing Sheets

U.S. PATENT DOCUMENTS 6,405,940 B2 6/2002 Harcombe et al.
6,408,801 B1 6/2002 Frostick et al.
6,412,712 B1 7/2002 Buckley
6,420,817 B1 7/2002 Ricci-Ottati et al.
6,421,913 B1 7/2002 Bonnah, II et al.
6,422,199 B1 7/2002 Buckley et al.
6,422,210 B1 7/2002 Lambert et al.
6,425,368 B1 7/2002 Lambert
6,431,469 B2 8/2002 Lambert et al.
6,434,822 B1 8/2002 Perry et al.
6,454,191 B1 9/2002 Spakowski et al.
6,454,192 B2 9/2002 Perry
6,464,153 B1 10/2002 Bonnah, II et al.
6,467,702 B1 10/2002 Lambert et al.
6,471,142 B1 10/2002 Lambert
6,481,641 B1 11/2002 Mieney
6,502,555 B1 1/2003 Harcombe et al.
6,508,416 B1 1/2003 Mastro et al.
6,511,004 B2 1/2003 Landschoot et al.
6,513,733 B1 2/2003 Lambert
6,520,154 B2 2/2003 Lamb et al.
6,588,102 B1 7/2003 Perry et al.
6,601,784 B2 8/2003 Muller-Girard, Jr. et al.
6,612,508 B2 9/2003 Lambert
6,616,070 B1 9/2003 Kunkulagunta
6,629,650 B2 10/2003 Curran et al.

* cited by examiner

FUEL INJECTOR

TECHNICAL FIELD

This invention relates to a fuel injector for use in supplying fuel, under pressure, to the cylinders of an internal combustion engine.

BACKGROUND OF THE INVENTION

A known fuel injector arrangement comprises a plunger reciprocable within a plunger bore provided in a housing to pressurise fuel located within a pump chamber defined by the plunger bore. The plunger bore communicates with a fuel pressure actuated injector such that, once the fuel pressure within the plunger bore exceeds a predetermined level, the injector opens and, thus, fuel injection commences.

SUMMARY OF THE INVENTION

In order to permit independent control of the injection pressure and the timing of injection, it is known to provide a spill valve which communicates with the pump chamber, and an injection control valve which controls fuel pressure within a control chamber defined, in part, by a surface associated with a valve needle of the injector to control movement of the needle. In use, the spill valve remains open during initial inward movement of the plunger. Subsequently, the spill valve is closed, further inward movement of the plunger pressurising the fuel within the pump chamber. When injection is to commence, the injection control valve is actuated to connect the control chamber to a low pressure drain thus permitting movement of the needle away from its seating to commence fuel injection.

European Patent Application No 0840003 describes a fuel injector of the aforementioned type, including a spill valve arrangement, which is controlled by means of a first actuator, and an injection control valve, which is controlled by means of a second actuator. As the fuel injector requires two actuator arrangements to independently control the spill valve and the injection control valve, the cost of the injector is high, particularly if piezoelectric actuators are employed.

European Patent Application No 0905719 describes a method of independently controlling the spill valve and the injection control valve of a fuel injector by means of a single, electromagnetic actuator arrangement. When it is desired to pressurise fuel within the pump chamber, the spill valve is closed by energising the actuator to a first, relatively low energisation level, during which stage of operation the injection control valve remains closed to low pressure. In order to commence fuel injection, the actuator is energised to a second, higher energisation level to open the injection control valve to low pressure. When the injection control valve is open to low pressure, the fuel injector valve needle is moved inwardly to permit fuel injection through outlet openings provided in the fuel injector nozzle body.

In order to permit full filling of the pump chamber and to minimise the volume of the plunger bore and maximise the peak fuel pressure, it is desirable to locate the spill valve in close proximity to the plunger. In addition, it is desirable to locate the injection control valve in close proximity to the valve needle as this improves the response of the valve needle. However, it is difficult to satisfy both of these requirements using the fuel injector arrangements described hereinbefore.

It is an object of the invention to provide a fuel injector which alleviates this problem.

According to the present invention there is provided a fuel injector for use in an injector arrangement including a pumping plunger and a pump chamber and a spill valve arrangement controlling communication between the pump chamber and a low pressure fuel reservoir, the fuel injector comprising a valve needle engageable with a seating to control fuel delivery through a fuel injector outlet opening, a first control chamber being arranged such that the fuel pressure therein acts on a surface associated with the valve needle and a second control chamber being arranged such that fuel pressure therein acts on a surface associated with the spill valve arrangement, and a piezoelectric actuator arrangement including a piezoelectric element having first and second ends, the first end being associated with the spill valve arrangement and the second end being associated with the valve needle such that, in use, operation of the spill valve arrangement and movement of the valve needle is controlled by controlling the energisation level of the piezoelectric element.

The invention provides the advantage that only a single piezoelectric actuator arrangement is required. This reduces the cost of the fuel injector. Additionally, the spill valve and the control chamber associated with the valve needle can both be located in close proximity to the piezoelectric actuator arrangement. Thus, the response of the valve needle is improved.

The fuel injector conveniently includes first and second piston members, the first piston member being moveable with the first end of the piezoelectric element and the second piston member being movable with the second end of the piezoelectric element, movement of the first and second piston members being controlled by varying the energisation level of the piezoelectric element.

Conveniently, the first and second piston members are slidable within first and second bores respectively. The first bore may define, in part, the first control chamber and the second bore may define, in part, the second control chamber. Movement of the first piston member within the first bore varies the volume of the first control chamber and movement of the second piston member within the second bore varies the volume of the second control chamber.

The first piston member may have a smaller diameter than the second piston member such that de-energisation of the piezoelectric element to a first energisation level causes movement of the second piston member to close the spill valve arrangement and further de-energisation of the piezoelectric element to a second, lower energisation level causes movement of the first piston member to move the valve needle away from the seating.

Alternatively, the first piston member may have a diameter greater than the diameter of the second piston member such that energisation of the piezoelectric element to a first energisation level causes movement of the second piston member to close the spill valve arrangement and further energisation of the piezoelectric element to a second, higher energisation level causes movement of the first piston member to move the valve needle away from the seating.

In one embodiment of the invention, the fuel injector may further comprise an injection control valve arrangement including a control valve member and a third control chamber for fuel, a surface of the control valve member being exposed to fuel pressure within the third control chamber, the control valve member being engageable with a further seating to control fuel pressure within the first control chamber.

Conveniently, the spill valve arrangement comprises a spill valve member which is slidable within a further bore defining, in part, an additional chamber. The spill valve member may be engageable with a further seating to control communication between the additional chamber and a low pressure fuel reservoir. Alternatively, the additional chamber may communicate directly with a low pressure fuel reservoir.

In an alternative embodiment, the first control chamber may be arranged to communicate directly, by means of a first restricted flow path, with a supply passage for supplying fuel under high pressure to the injector.

The second control chamber may be arranged to communicate directly, by means of a second restricted flow path, with a supply passage for supplying fuel under high pressure to the injector.

The piezoelectric actuator arrangement may include a single piezoelectric element or may include a stack of piezoelectric elements.

The valve needle may be of the inwardly or outwardly opening type.

BRIEF DESCRIPTION OF THE DRAWINGS

The invention will now be described, by way of example only, with reference to the accompanying drawings, in which.

DETAILED DESCRIPTION OF THE PREFERRED EMBODIMENT

Figure 1:
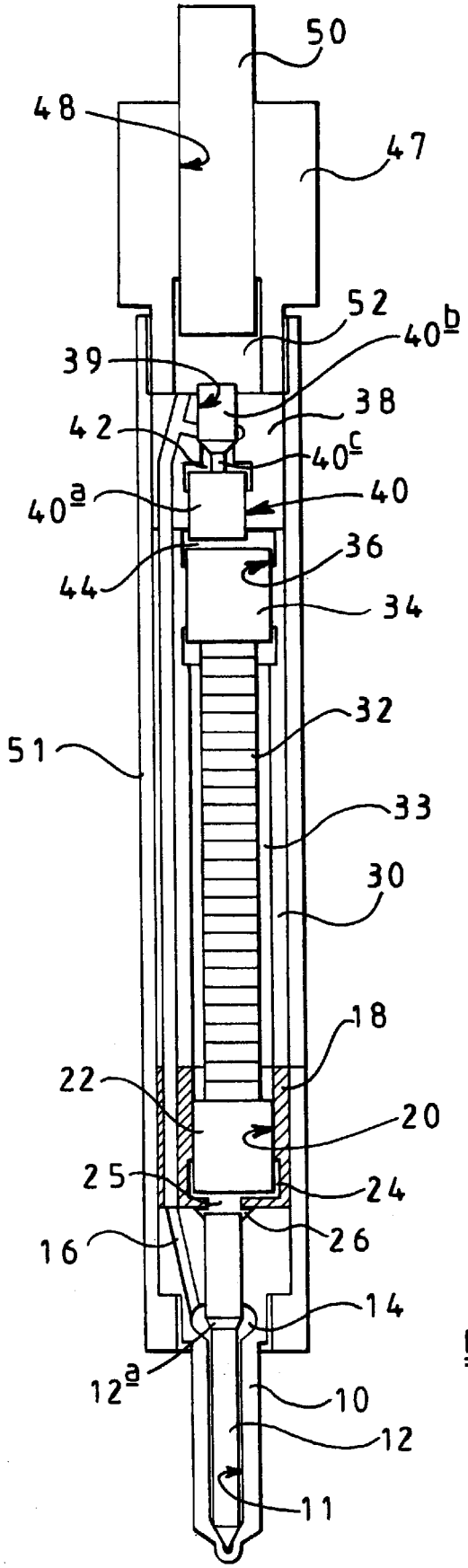
FIG. 1 is a cross-sectional view of a fuel injector in accordance with an embodiment of the present invention.
Figure 2:
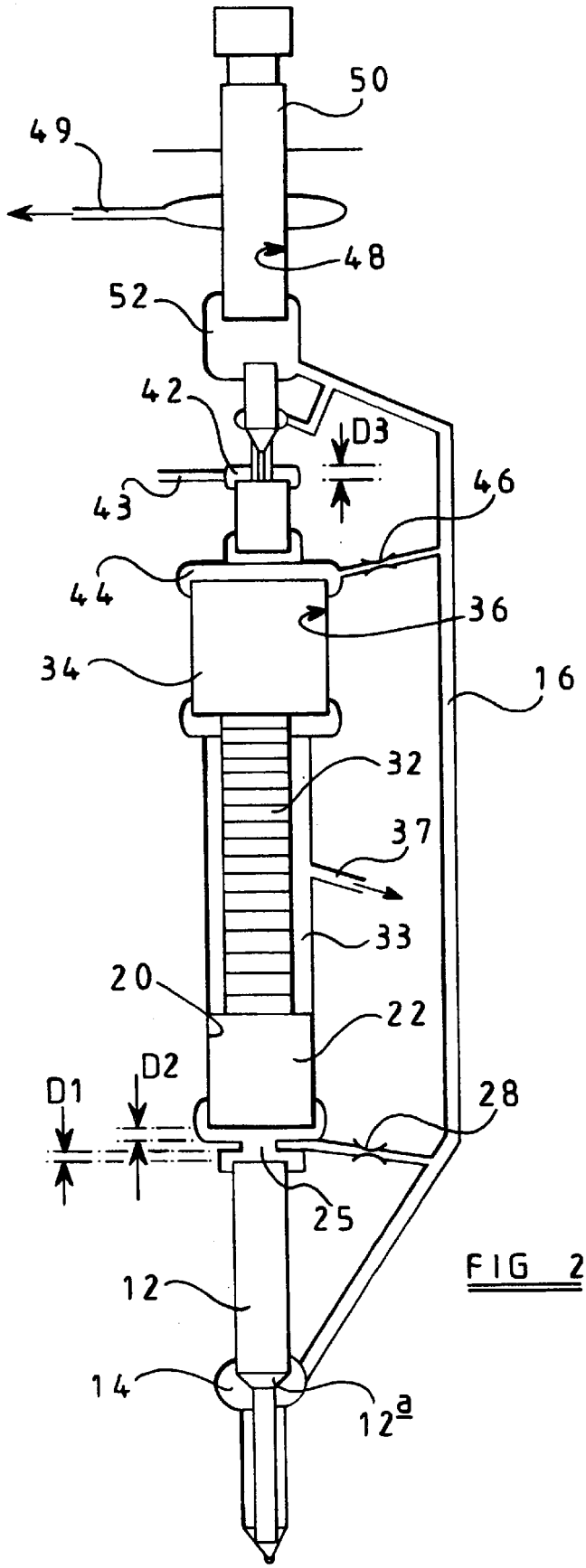
FIG. 2 is a schematic view of the fuel injector in FIG. 1.

Referring to FIGS. 1 and 2, the fuel injector includes a valve needle 12 which is reciprocable within a bore 11 provided in a nozzle body 10. The valve needle 12 is engageable with a seating defined by the bore 11 to control fuel delivery through one or more outlet openings (not shown) provided in the nozzle body 10. The bore provided in the nozzle body 10 includes a region of enlarged diameter which defines an annular chamber 14, fuel being supplied to the annular chamber 14 by means of a supply passage 16, in use. The valve needle 12 is provided with one or more thrust surfaces 12*a* which are exposed to fuel pressure within the annular chamber 14.

The upper end of the nozzle body 10 abuts a distance piece 18 which is provided with a bore 20 of stepped form, a first piston member 22 being slidable within an upper region of the bore 20. The bore 20 includes a region having a diameter greater than that of the piston member 22, and includes a region of reduced diameter which communicates with a recess 26 provided in the upper end face of the nozzle body 10, the recess 26, the lower end face of the piston member 22 and the bore 20 together defining a first control chamber 25 for fuel. In use, fuel pressure within the control chamber 25 acts on the upper end face of the valve needle 12 and serves to urge the valve needle 12 in a downwards direction in the illustration shown against the seating defined by the bore 11. As indicated in FIG. 2, the upper end face of the valve needle 12 and the lower end face of the distance piece 18 together define a clearance gap, D1, which serves to limit the extent of movement of the valve needle 12 within the bore 11. Additionally, the lower end face of the first piston member 22 and an upwardly directed interal surface of the control chamber 25 together define a second clearance gap, D2, which serves to limit the extent of movement of the piston member 22 within the bore 20, the bore 20 being provided with a step which defines a stop for the piston member 22 when the piston member 22 has moved through a distance equal to D2 in a downward direction, in the illustration shown.

The distance piece 18 is provided with a drilling which forms part of the supply passage 16 for fuel. As shown in FIG. 2, the supply passage 16 communicates, by means of a restricted passage 28, with the first control chamber 25. The control chamber 25 is also supplied with high pressure fuel through leakage from the bore 11. Alternatively, the control chamber 25 may communicate with the supply passage 16 through leakage alone, rather than by providing the restricted passage 28.

The distance piece 18 abuts a housing 30 within which a piezoelectric actuator arrangement is arranged, the piezoelectric actuator arrangement including a piezoelectric stack 32 which is housed within a chamber 33 defined within the housing 30. In use, the energisation level, and hence the axial length, of the piezoelectric stack 32 may be varied by varying the voltage applied to the stack 32. One end of the piezoelectric stack 32 is in connection with the piston member 22, the other end of the piezoelectric stack 32 being in connection with a second piston member 34 which is reciprocable within a bore 36 provided in the housing 30. The piezoelectric stack is housed within a chamber which is connected, by means of a passage 37, to a low pressure fuel reservoir or drain. Thus, in use, any fuel under high pressure which leaks into the chamber housing the piezoelectric stack 32 is able to escape to low pressure through the passage 37.

At its end remote from the distance piece 18, the housing 30 abuts a further housing 38 for a spill valve arrangement, the spill valve arrangement including a spill valve member 40 including a region 40*a* of enlarged diameter, a region 40*b* of reduced diameter and an intermediate region 40*c* of further reduced diameter. The spill valve member 40 is slidable within a through bore 39 of stepped form provided in the housing 38. The diameter of the spill valve member region 40*b* is substantially the same as the diameter of the adjacent part of the bore 39 such that movement of the spill valve member 40 is guided within the bore. The upper surface of the enlarged region 40*a* of the spill valve member 40 and the step in the bore 39 together defining a clearance gap, D3, which serves to limit the extent of movement of the spill valve member 40 within the bore 39. A surface of the spill valve member 40 defined between the intermediate region 40*c* and the region 40*b* is engageable with a valve seating defined by the bore 39 to control communication between the supply passage 16 and a chamber 42 defined by a region of the bore 39. The chamber 42 communicates with the low pressure fuel reservoir by means of a flow passage 43.

It will be appreciated that the enlarged region 40*a* and the intermediate region 40*c* of the spill valve member 40, or the intermediate region 40*c* and the region 40*b* of the spill valve member 40, may be integrally formed. Alternatively, the regions 40*a*, 40*b* and 40*c* of the spill valve member 40 may be separate components which are held together by forces due to fuel pressure or by means of biasing springs.

The lower end face of the enlarged region 40*a* of the spill valve member 40, the bore 36 provided in the housing 30 and the upper end face of the piston member 34 together define a second control chamber 44 for fuel, the chamber 44 being in communication with the supply passage 16 by means of a restricted passage 46, as indicated in FIG. 2. The diameter of the first piston member 22 is slightly smaller than the diameter of the second piston member 34. Thus, the effective surface area of the piston member 22 exposed to fuel pressure within the chamber 25 is slightly smaller than the effective surface area of the second piston member 34 exposed to fuel pressure within the chamber 44.

The housing 38 abuts, at its end remote from the housing 30, a further housing 47, the nozzle body 10, the distance piece 18 and the housings 30, 38, 47 being received within a cap nut 51. The housing 47 is provided with a bore 48 which defines a pump chamber 52 for fuel. A pumping plunger 50 is reciprocable within the bore 48 to vary the volume of the pump chamber 52, the pumping plunger 50 being cooperable with a cam arrangement (not shown) which is carried by a drive shaft such that, upon rotation of the drive shaft, reciprocating motion is transmitted to the pumping plunger 50. The bore 48 communicates with the low pressure fuel reservoir by means of a flow passage 49 provided in the housing 47.

The pump chamber 52 communicates with the supply passage 16 such that, in use, during outward movement of the pumping plunger 50 within the bore 48 and with the spill valve member 40 in its open position, fuel is drawn into the pump chamber 52, subsequent inward movement of the pumping plunger 50 within the bore 48 causing fuel to be expelled from the pump chamber 52, past the valve seating, into the chamber 42 and to the low pressure fuel reservoir. If the spill valve member 40 is moved to its closed position, fuel within the pump chamber 52 is unable to flow to low pressure such that inward movement of the pumping plunger 50 within the bore 48 causes pressurisation of fuel within the pump chamber 52, high pressure fuel therefore being supplied through the supply passage 16 to the downstream parts of the fuel injector.

In use, starting from a position in which the piezoelectric stack 32 is energised to a higher energisation level, and with the spill valve member 40 in its open position, fuel within the pump chamber 52 is able to escape to low pressure as the pumping plunger 50 reciprocates within the bore 48. Fuel within the pump chamber is able to flow through the supply passage 16 into the annular chamber 14, into the first control chamber 25 through the passage 28, and through leakage from the bore 11, and into the second control chamber 44 through the passage 46. Fuel pressure within the chamber 25 acts on the upper end face of the valve needle 12 and, as the effective area of the end face of the valve needle 12 exposed to fuel pressure within the chamber 25 is greater than the effective area of the thrust surface 12*a* exposed to fuel pressure within the chamber 14, the valve needle 12 is urged against the seating to prevent fuel delivery through the outlet openings provided in the nozzle body 10. Thus, fuel injection does not take place. It will be appreciated that the valve needle 12 may also be urged against its seating by means of a compression spring (not shown) in a conventional manner. Fuel within the passage 43 and in the control chambers 25, 44 is at a higher pressure than fuel within the passage 37 and the chamber 33 and, as the piston member 34 has a larger effective area exposed to fuel pressure than the piston member 22, the net force on the piezoelectric stack 32 is therefore in a downwards direction causing the piston member 22 to be urged in a downwards direction to close the clearance gap D2.

When fuel pressurisation is to be commenced, the actuator is partly de-energised to a first, reduced energisation level causing the length of the piezoelectric stack 32 to contract to a first, reduced length. As the diameter of the piston member 34 is slightly greater than the diameter of the piston member 22, the effective area of the piston member 34 exposed to fuel pressure within the chamber 44 is greater than the effective area of the piston member 22 exposed to fuel pressure within the chamber 25. Thus, as a result of the contraction in length of the piezoelectric stack 32 to the first, reduced length, the second piston member 34 will be caused to move by a greater amount than the piston member 22 which should remain against its stop defined by the bore 20. As a result, the volume of the chamber 44 is increased such that fuel pressure within the chamber 44 reduces, fuel only being supplied to the chamber 44 at a restricted rate through the restricted passage 46. The force applied to the end face of the enlarged region 40*b* of the spill valve member 40 is therefore reduced, fuel pressure within the pump chamber 52 acting on the end face of the region 40*b* of the spill valve member 40 so as to urge the spill valve member 40 against its seating to close communication between the supply passage 16 and the low pressure fuel reservoir. Thus, during continued inward movement of the pumping plunger 50 within the bore 48, fuel pressure within the pump chamber 52 increases and fuel under high pressure is delivered through the supply passage 16 to the downstream parts of the fuel injector.

When fuel injection is to be commenced, the piezoelectric actuator is further de-energised to a second, further reduced energisation level, the length of the piezoelectric stack 32 thereby contracting to a further reduced, second length. As the spill valve member 40 is seated, any further contraction of the length of the piezoelectric stack 32 gives rise to a relative reduction in fuel pressure within the control chamber 44 to permit the piston member 22 to move away from its stop defined by the bore 20. Thus, as fuel is only able to flow into the chamber 25 at a restricted rate through the restricted passage 28, when the piezoelectric stack 32 is further contracted, the first piston member 22 is moved in an inwards direction in the illustration shown in FIG. 1, thereby increasing the volume of the chamber 25. The force applied to the upper end face of the valve needle 12 is thereby reduced, fuel pressure within the chamber 14 acting on the thrust surface 12*a* of the valve needle 12 and serving to urge the valve needle 12 in an upwards direction away from the seating to permit fuel delivery through the outlet openings provided in the nozzle body 10. Fuel is therefore injected into the engine cylinder or other combustion space. Movement of the valve needle 12 away from its seating is limited by the clearance gap, D1, defined between the upper end face of the valve needle 12 and the distance piece 18.

In order to cease fuel injection, the actuator arrangement is re-energised to the first energisation level, thereby increasing the length of the piezoelectric stack 32 to the first length. The piston member 22 is therefore caused to move downwardly within the bore 20 to reduce the volume of the chamber 25, fuel pressure within the chamber 25 thereby being increased. Thus, the force applied to the upper end face of the valve needle 12 is also increased and is sufficient to overcome the force applied to the thrust surface 12*a* of the valve needle 12 such that the valve needle 12 is returned to its seated position. Thus, fuel delivery through the outlet openings ceases. During this stage of operation, as the length of the piezoelectric stack 32 is increased, the second piston member 34 is moved upwardly to reduce the volume of the chamber 44. However, although fuel pressure within the chamber 44 increases, the force on the enlarged region 40*a* of the spill valve member 40 is insufficient to overcome the downward force on the region 40*b* of the spill valve member 40 due to fuel pressure within the chamber 52. The spill valve member 40 therefore remains seated against its seating to maintain fuel pressurisation within the pump chamber 52.

In order to cease fuel pressurisation, the piezoelectric stack is energised to the initial, higher energisation level to increase the length of the piezoelectric stack 32 to the initial length, the piston member 34 therefore being moved in an upwards direction to reduce the volume of the chamber 44. Fuel pressure within the chamber 44 therefore increases, the force on the enlarged region 40*a* of the spill valve member 40 due to fuel pressure within the chamber 44 being sufficient to overcome the downward force on the region 40*b* of the spill valve member 40 due to fuel pressure within the chamber 52 such that the spill valve member 40 is urged away from its seating to open communication between the supply passage 16 and the low pressure fuel reservoir. Thus, continued inward movement of the pumping plunger 50 within the bore 48 does not result in pressurisation of fuel.

During the fuel injecting stage, it may be preferable to de-energise the piezoelectric actuator to an energisation level slightly less than the second energisation level to ensure a net flow of fuel into the chamber 25 from the supply passage 16 is maintained. Thus, when fuel injection is to be ceased, and the piezoelectric stack 32 is re-energised, closure of the valve needle 12 against its seating is assured before the piston member 22 reaches its stop defined by the bore 20.

By utilising both ends of the piezoelectric stack to control movement of the spill valve member 40 and the valve needle 12 respectively, both the spill valve and the valve needle can conveniently be located in close proximity to the pump chamber 52 and the control chamber 25 respectively. Thus, the response of the valve needle is improved. Additionally, as only one piezoelectric actuator is required, the cost of the fuel injector is reduced significantly.

Figure 3:
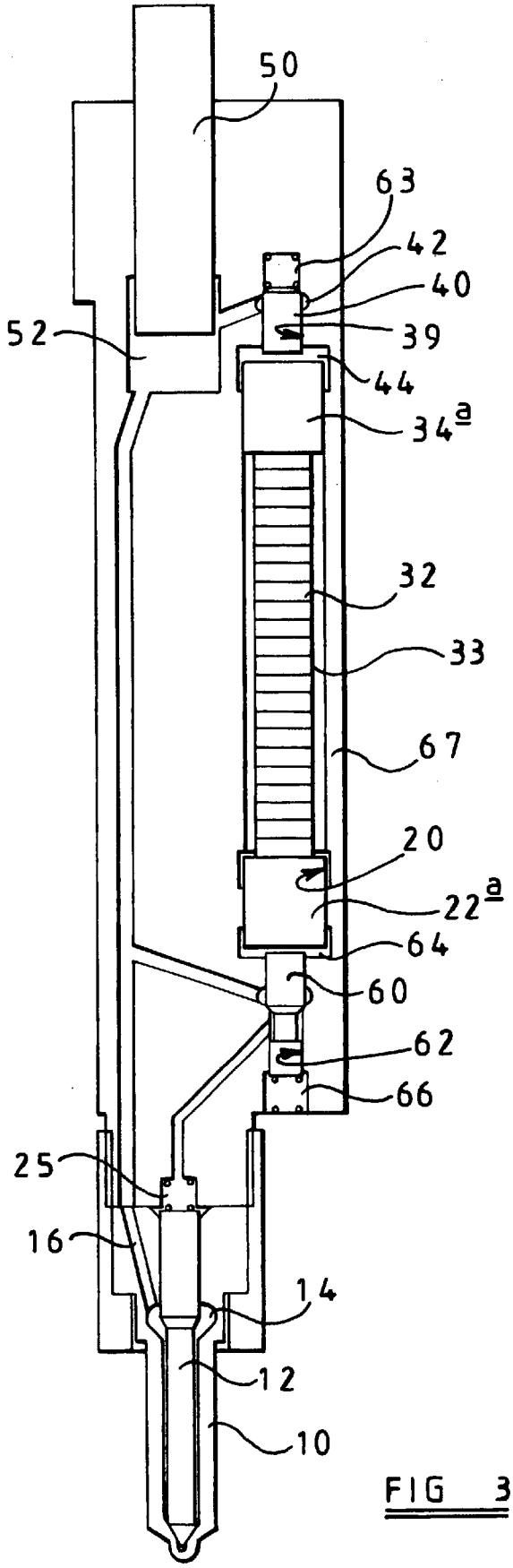
FIG. 3 is a cross-sectional view of an alternative embodiment.
Figure 4:
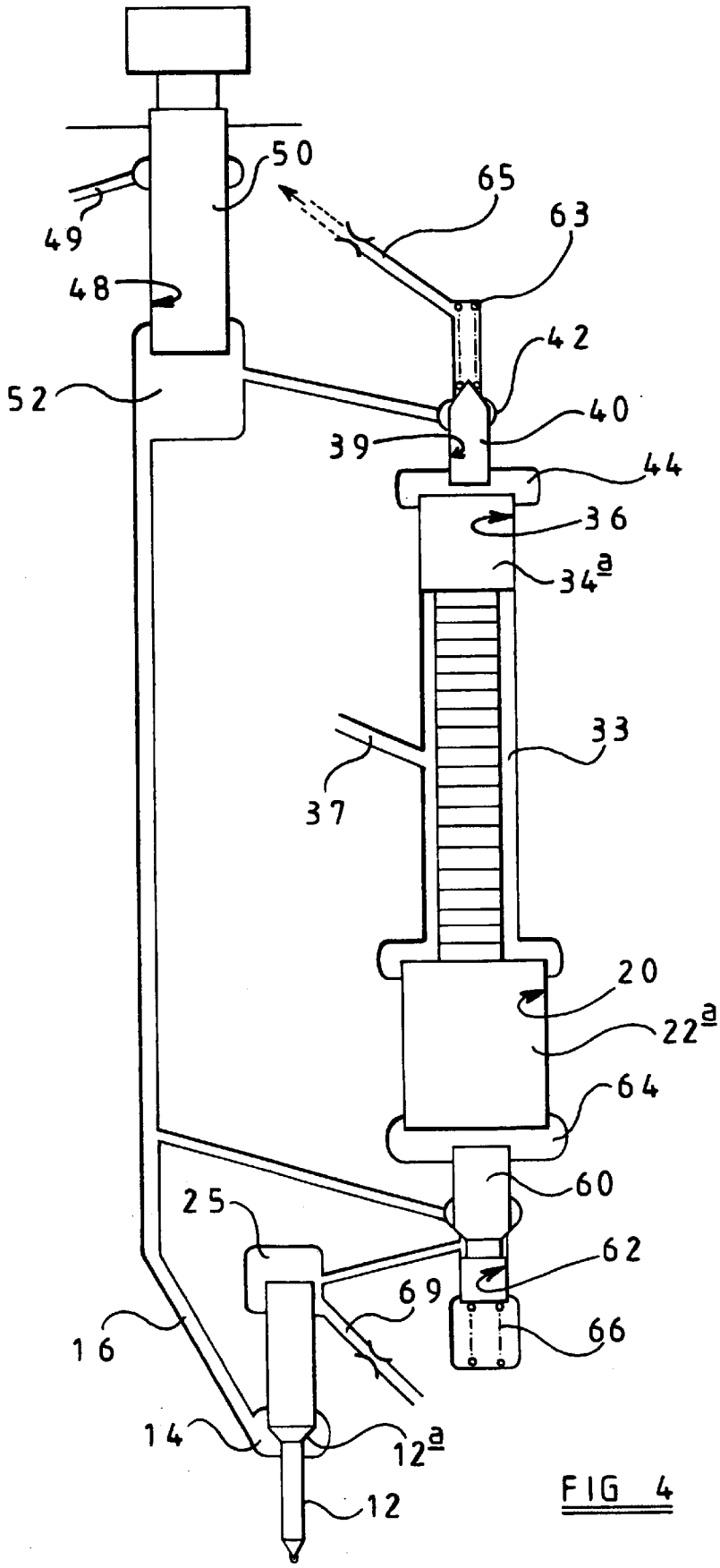
FIG. 4 is a schematic view of the fuel injector in FIG. 3.

In the embodiments of the invention shown in FIGS. 1 and 2, the control chambers 25, 44 communicate directly, via the restricted passages 28, 46 respectively, with the supply passage 16. As shown in FIGS. 3 and 4, in an alternative embodiment the fuel injector includes an injection control valve arrangement including a control valve member 60 which is slidable within a bore 62 provided in a fuel injector housing 67. The fuel injector includes a first piston member 22*a* and a second piston member 34*a*, the first piston member 22*a* having a diameter slightly greater than the diameter of the second piston member 34*a*.

The control valve member 60 has an end face which is exposed to fuel pressure within a third control chamber 64, the control valve member 60 being engageable with a seating defined by the bore 62 to control communication between the supply passage 16 and the control chamber 25. Thus, the supply passage 16 does not communicate directly with the control chamber 25, as is the case in the embodiment shown in FIGS. 1 and 2, the control chamber 25 being connected, via a restricted passage 69, to the low pressure fuel reservoir. A spring 66 is housed within the bore 62, the spring 66 serving to urge the control valve member 60 away from its seating to open communication between the supply passage 16 and the chamber 25.

The chamber 42 defined by the bore 39 also does not communicate directly with the low pressure fuel reservoir, communication between the chamber 42 and the low pressure fuel reservoir being controlled by means of the spill valve member 40, fuel being able to flow between the low pressure fuel reservoir and the chamber 42 by means of a restricted passage 65 when the spill valve member 40 is lifted away from its seating. The spill valve member 40 is urged away from the valve seating defined by the bore 39 by means of a spring 63 housed within an end of the bore 39. Between fuel injections, the control chambers 44, 64 fill with fuel through leakage and, as the piston member 34*a* has a smaller effective area exposed to fuel pressure than the piston member 22*a*, and as the chamber within which the piezoelectric stack 32 is housed communicates with the low pressure fuel reservoir, the piezoelectric stack 32 will be moved upwardly until the piston member 22*a* reaches its stop defined by a bore in the housing 67.

In use, when fuel pressurisation is to be commenced, the piezoelectric actuator is energised to a first, relatively low energisation level, to extend the length of the piezoelectric stack 32. As the effective area of the piston member 22*a* exposed to fuel pressure within the chamber 64 is greater than the effective area of the piston member 34*a* exposed to fuel pressure within the chamber 44, the piston member 34*a* is moved in an upwards direction within the bore 36, thereby reducing the volume of the chamber 44. Thus, fuel pressure within the chamber 44 is increased and is sufficient to overcome the spring force due to the spring 63, the spill valve member 40 therefore being urged against its seating to close communication between the pump chamber 52 and the low pressure fuel reservoir. Continued, reciprocal motion of the pumping plunger 50 within the bore 48 therefore causes pressurisation of fuel within the pump chamber 52.

When fuel injection is to be commenced, the piezoelectric actuator is energised to a second, higher energisation level to further increase the length of the piezoelectric stack 32. As the spill valve member 40 is seated and the control chamber 44 is closed, the first piston member 22*a* is caused to move downwardly within the bore 20, reducing the volume of the chamber 64 and increasing fuel pressure therein. The force applied to the end face of the control valve member 60 exposed to fuel pressure within the chamber 64 is therefore increased and is sufficient to overcome the force due to the spring 66, the control valve member 60 thereby being urged against its seating to close communication between the supply passage 16 and the control chamber 25.

Thus, during this stage of operation, fuel pressure within the control chamber 25 is reduced, thereby reducing the force applied to the upper end face of the valve needle 12. The valve needle 12 is therefore lifted away from its seating due to fuel pressure within the chamber 14 acting on the thrust surface 12*a*. With the valve needle 12 lifted away from the seating fuel injection takes place through the outlet openings provided in the nozzle body. It will be appreciated that, although the separate fuel injector housing components are not shown in FIG. 3, the fuel injector may comprise similar housing components to those shown in FIG. 1.

By utilising both ends of the piezoelectric stack to control movement of the spill valve member and the control valve member, both the spill valve and the control valve can be located in close proximity to the pump chamber 52 and the control chamber 25 respectively. Additionally, only one piezoelectric actuator arrangement is required, thereby reducing the cost of the fuel injector.

In an alternative embodiment to that shown in FIG. 3 and 4, a surface associated with an outwardly opening valve needle may be exposed to fuel pressure within the control chamber 64 such that, when the piezoelectric stack is energised to cause movement of the piston member 22*a* and an increase in fuel pressure within the chamber 64, the force applied to the surface associated with the valve needle is also increased to move the valve needle outwardly, thereby permitting fuel delivery into the engine cylinder or other combustion space.

It will be appreciated that the piezoelectric actuator arrangement need not include a stack 32 of peizoelectic elements, but may include a single piezoelectric element.

What is claimed is:

1. A fuel injector for use in an injector arrangement including a pumping plunger, a pump chamber and a spill valve arrangement for controlling communication between the pump chamber and a low pressure fuel reservoir, the fuel injector comprising a valve needle engageable with a seating to control fuel delivery through a fuel injector outlet opening, a first control chamber being arranged such that the fuel pressure therein acts on a surface associated with the valve needle and a second control chamber being arranged such that fuel pressure therein acts on a surface associated with the spill valve arrangement, and a piezoelectric actuator arrangement including a piezoelectric element having first and second ends, the first end being associated with the spill valve arrangement and the second end being associated with the valve needle such that, in use, operation of the spill valve arrangement and movement of the valve needle is controlled by controlling energisation level of the piezoelectric element.

2. The fuel injector as claimed in claim 1, wherein the fuel injector includes first and second piston members, the first piston member being moveable with the first end of the piezoelectric element and the second piston member being movable with the second end of the piezoelectric element, movement of the first and second piston members being controlled by varying the energisation level of the piezoelectric element.

3. The fuel injector as claimed in claim 2, wherein the first and second piston members are slidable within first and second bores respectively, the first bore defining, in part, the first control chamber and the second bore defining, in part, the second control chamber.

4. The fuel injector as claimed in claim 2, wherein the first piston member has a smaller diameter than a diameter the second piston member such that de-energisation of the piezoelectric element to a first energisation level causes movement of the second piston member to close the spill valve arrangement so as to close communication between the pump chamber and the low pressure fuel reservoir, further de-energisation of the piezoelectric element to a second, lower energisation level causing movement of the first piston member to move the valve needle away from the seating.

5. The fuel injector as claimed in claim 2, wherein the first piston member has a diameter greater than a diameter of the second piston member such that energisation of the piezoelectric element to a first energisation level causes movement of the second piston member to close the spill valve arrangement so as to close communication between the pump chamber and the low pressure fuel reservoir, further energisation of the piezoelectric element to a second, higher energisation level causing movement of the first piston member to move the valve needle away from the seating.

6. The fuel injector as claimed in claim 1, wherein the second control chamber is arranged to communicate directly, by means of a second restricted flow path, with a supply passage for supplying fuel under high pressure to the injector.

7. The fuel injector as claimed in claim 1, wherein the first control chamber is arranged to communicate directly, by means of a first restricted flow path, with a supply passage for supplying fuel under high pressure to the injector.

8. The fuel injector as claimed in claim 1, further comprising an injection control valve arrangement for controlling communication between the first control chamber and a supply passage for supplying fuel under high pressure to the injector.

9. The fuel injector as claimed in claim 8, wherein the injection control valve arrangement includes a control valve member and a third control chamber for fuel, a surface of the control valve member being exposed to fuel pressure within the third control chamber, the control valve member being engageable with a further seating to control communication between the first control chamber and the supply passage.

10. The fuel injector as claimed in claim 1, wherein the spill valve arrangement comprises a spill valve member which is slidable within a further bore defining, in part, an additional chamber, the spill valve member being engageable with a further seating to control communication between the additional chamber and a low pressure fuel reservoir.

11. The fuel injector as claimed in claim 1, wherein the piezoelectric actuator arrangement includes a stack of piezoelectric elements.

12. The fuel injector as claimed in claim 1, the injector being of the type in which inward movement of the value needle within a nozzle body bore results in injection of fuel through the outlet opening.

* * * * *